US006550579B2

(12) United States Patent
Gibson et al.

(10) Patent No.: US 6,550,579 B2
(45) Date of Patent: Apr. 22, 2003

(54) STEP STOOL

(75) Inventors: William R. Gibson, Kent, OH (US); Enrique Giner, Beverly Hills, MI (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/927,813

(22) Filed: Aug. 10, 2001

(65) Prior Publication Data

US 2002/0043431 A1 Apr. 18, 2002

Related U.S. Application Data

(60) Provisional application No. 60/224,595, filed on Aug. 11, 2000.

(51) Int. Cl.[7] ..... E06C 1/00
(52) U.S. Cl. ..... 182/161; 182/165
(58) Field of Search ..... 182/161, 165

(56) References Cited

U.S. PATENT DOCUMENTS

| | | | | |
|---|---|---|---|---|
| 162,075 | A | | 4/1875 | Isaacs et al. |
| 472,603 | A | * | 4/1892 | Hamilton ..... 297/60 |
| 1,702,249 | A | | 2/1929 | Davidson |
| 2,109,886 | A | | 3/1938 | Lewis |
| 2,207,923 | A | | 7/1940 | Kelso |
| 2,280,691 | A | | 4/1942 | Edelmann |
| 2,525,104 | A | | 10/1950 | Cyr |
| 2,596,521 | A | | 5/1952 | Bell |
| 2,805,104 | A | | 9/1957 | Johnson |
| 2,899,011 | A | | 8/1959 | Babits |
| 3,224,530 | A | | 12/1965 | King et al. |
| 3,999,629 | A | | 12/1976 | Schaffer et al. |
| 4,440,264 | A | | 4/1984 | Knoke et al. |
| 4,485,892 | A | | 12/1984 | Maloney et al. |
| 4,494,626 | A | | 1/1985 | Ast |
| 4,502,564 | A | | 3/1985 | Kümmerlin et al. |
| 5,064,243 | A | | 11/1991 | Quain |
| 5,419,409 | A | | 5/1995 | Corulla |
| 5,722,507 | A | | 3/1998 | Kain |
| 5,762,163 | A | | 6/1998 | Kain |
| 5,937,968 | A | | 8/1999 | Gibson et al. |
| 5,967,260 | A | | 10/1999 | Spak |
| 5,992,567 | A | * | 11/1999 | Chiu ..... 182/161 |
| 6,026,933 | A | | 2/2000 | King et al. |
| 6,390,237 | B1 | * | 5/2002 | Kim et al. ..... 182/129 |

FOREIGN PATENT DOCUMENTS

| | | |
|---|---|---|
| WO | WO 00/40824 | 7/2000 |

OTHER PUBLICATIONS

11–135 Two Step™ Folding Step Stool, Cosco® A Dorel Company, Home Furnishings, 1996, p. 17.
11–302 Big Step™ Folding Step Stool and 11–307 Deluxe Big Step™ Folding Step Stool/Chair, Cosco® A Dorel Company, Home Furnishings, 1996, p. 18.

* cited by examiner

*Primary Examiner*—Alvin Chin-Shue
(74) *Attorney, Agent, or Firm*—Barnes & Thornburg

(57) ABSTRACT

A method for assembling a step stool includes the step of providing a frame including a front leg and a rear leg coupled to the front leg for pivotable movement between an opened use position and a collapsed storage position, a step coupled to the front leg for pivotable movement between a horizontal use position and a storage position, and a link including a body, a pivot coupled to the body and the step, and a connector coupled to the body. The method further includes the step of snapping the connector into engagement with the rear leg for movement of the rear leg from its opened use position to its closed storage position in response to movement of the step from its horizontal use position to its storage position.

31 Claims, 6 Drawing Sheets

STEP STOOL

CROSS-REFERENCE TO RELATED APPLICATION

This application claims priority under 35 U.S.C. §119(e) to U.S. Provisional Application No. 60/224,595, filed Aug. 11, 2000, which is expressly incorporated by reference herein.

BACKGROUND AND SUMMARY OF THE INVENTION

The present invention relates to a step stool, and particularly to a folding step stool including legs that fold between an opened use position and a collapsed storage position. More particularly, the present invention relates to a link coupled to the rear leg and a step of the step stool to coordinate movement of the rear leg and the step.

Step stools have a frame and one or more steps that individuals use for elevation when reaching for objects, painting walls, or any everyday task where extra elevation would be helpful. Step stool frames are often foldable for ease of storage while the step stool is not being used.

According to the disclosure, a method of assembling a step stool includes the steps of providing a frame including a front leg and a rear leg coupled to the front leg for pivotable movement between an opened use position and a collapsed storage position, a step coupled to the front leg for pivotable movement between a horizontal use position and a storage position, and a link including a body, a pivot coupled to the body and the step, and a connector coupled to the body. The method of assembly further includes the step of snapping the connector into engagement with the rear leg for movement of the rear leg from its opened use position to its closed storage position in response to movement of the step from its horizontal use position to its storage position.

In preferred embodiments, the link includes means for coupling the body to a strut of the rear leg upon pivoting the body about a pivot axis defined by the pivot in a plane perpendicular to a strut of the rear leg. The coupling means includes the connector and another connector. Each connector includes a hook that is coupled to the body and formed to include a channel sized to receive the strut and a detent coupled to the hook to retain the strut in the channel upon snapping the connector into engagement with the strut for movement of the rear leg from its opened use position to its closed storage position in response to movement of the step from its horizontal use position to its storage position.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
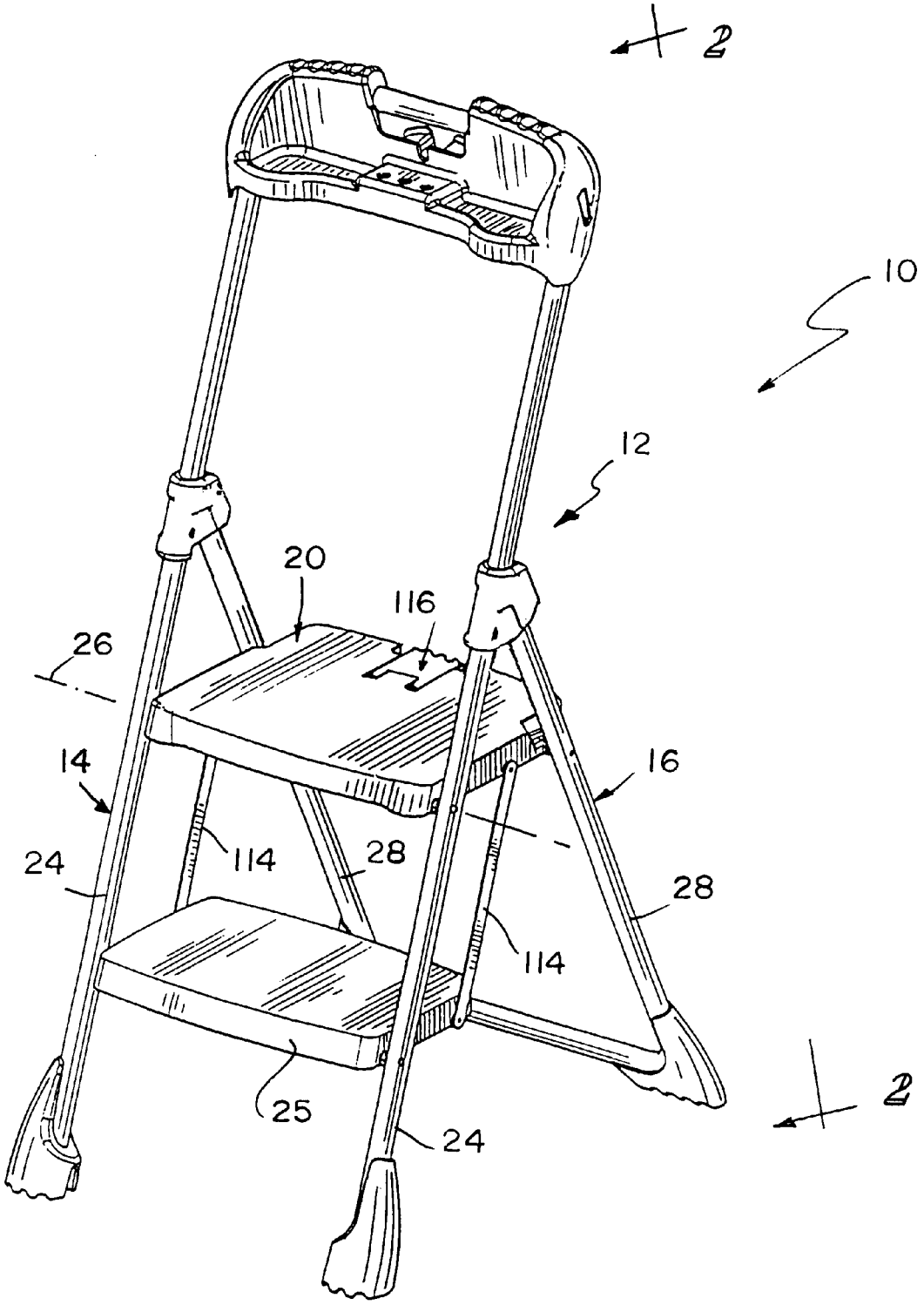
FIG. 1 is a perspective view of a step stool including a front leg, a rear leg coupled to the front leg in an opened use position, and top and bottom steps positioned in a horizontal use position.

A foldable step stool 10 includes a frame 12 having a front leg 14, a rear leg 16 including a strut 18, a top step 20, and a monolithic link 22 coupled to step 20 and strut 18 to coordinate movement of step 20 and rear leg 16, as shown, for example, in FIGS. 1–5. Link 22 is configured to be coupled to strut 18 and step 20 readily by snap engagement of link 22 with strut 18 and step 20 during assembly of step stool 10, as shown, for example, in FIGS. 8–10.

Figure 2:
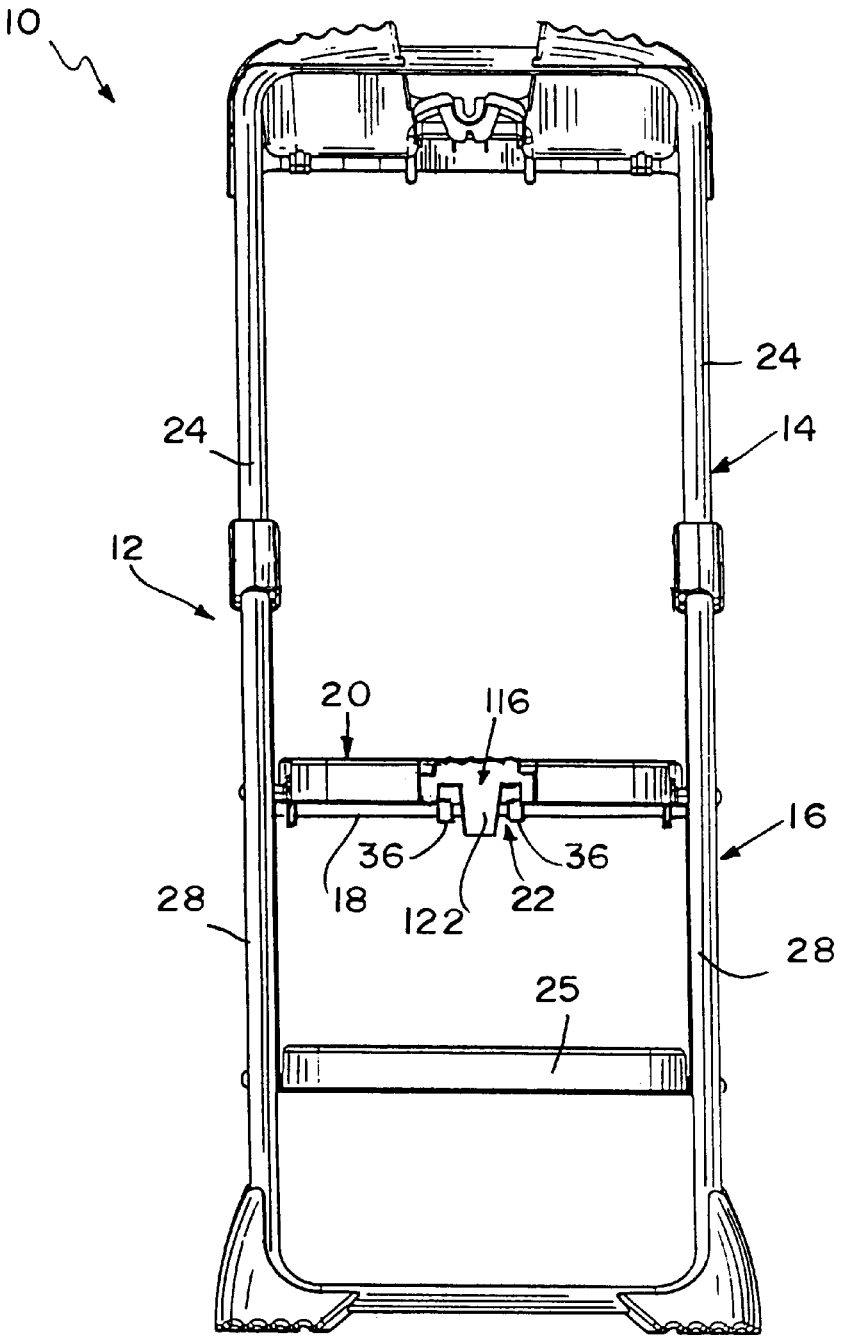
FIG. 2 is a rear elevation view taken along the line 2—2 of FIG. 1 showing the rear leg including a horizontal strut and the step stool also including a link coupled to the strut.
Figure 3:
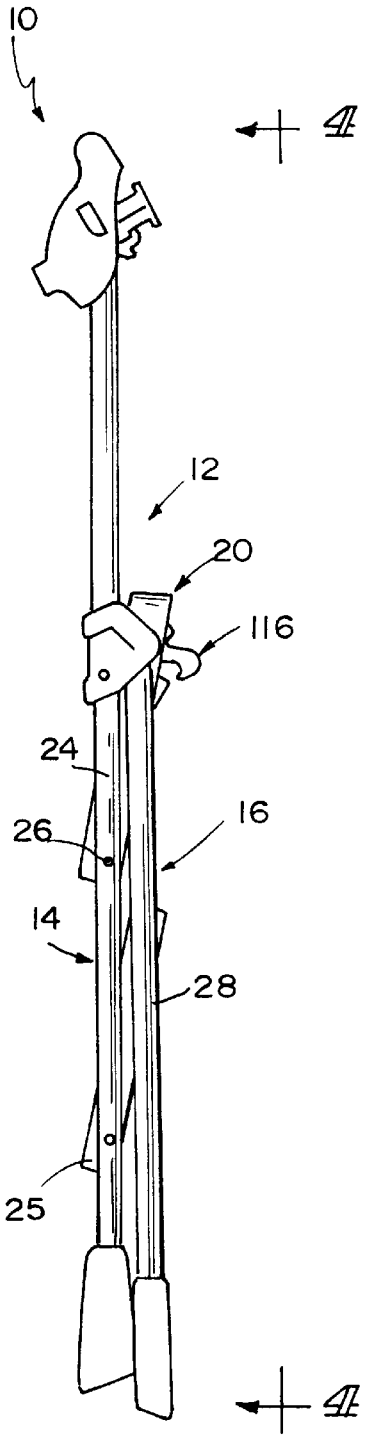
FIG. 3 is a side elevation view of the step stool of FIG. 1 showing the front and rear legs positioned in a closed storage position and the steps positioned in a closed position.
Figure 4:
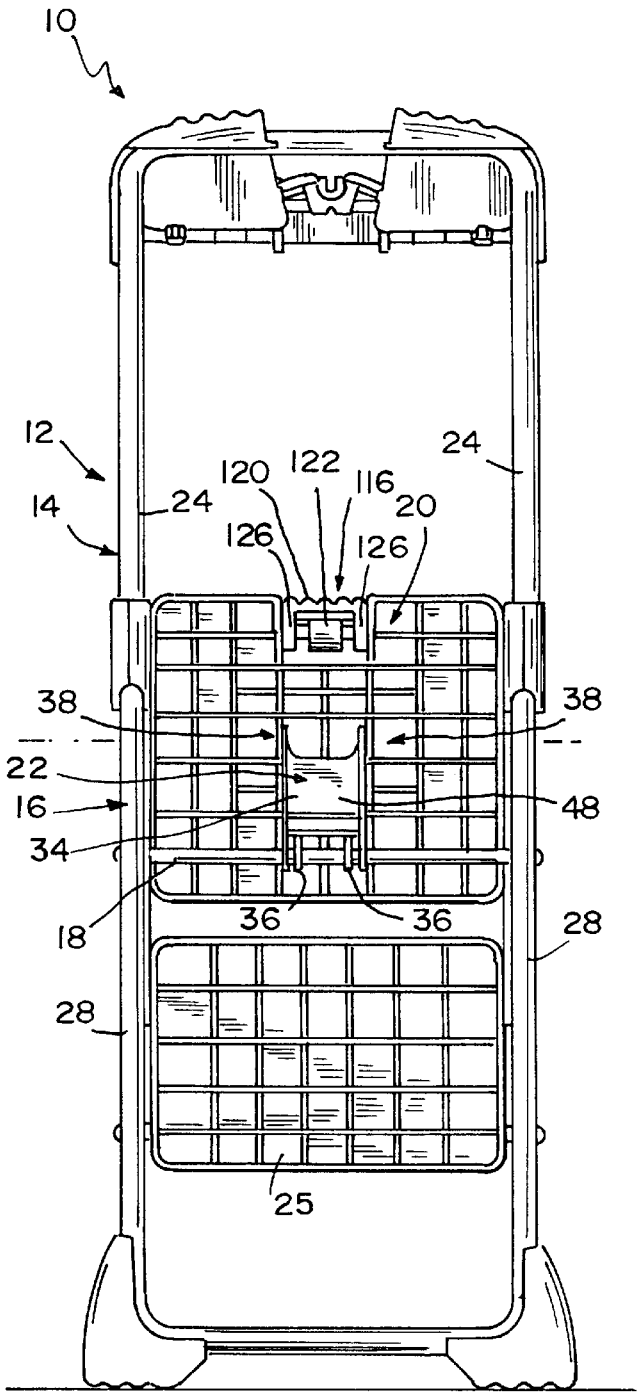
FIG. 4 is a rear elevation view taken along the line 4—4 of FIG. 3 showing the front and rear legs positioned in the closed storage position, the steps position in the closed position, and the link coupled to the top step and the strut.
Figure 7:
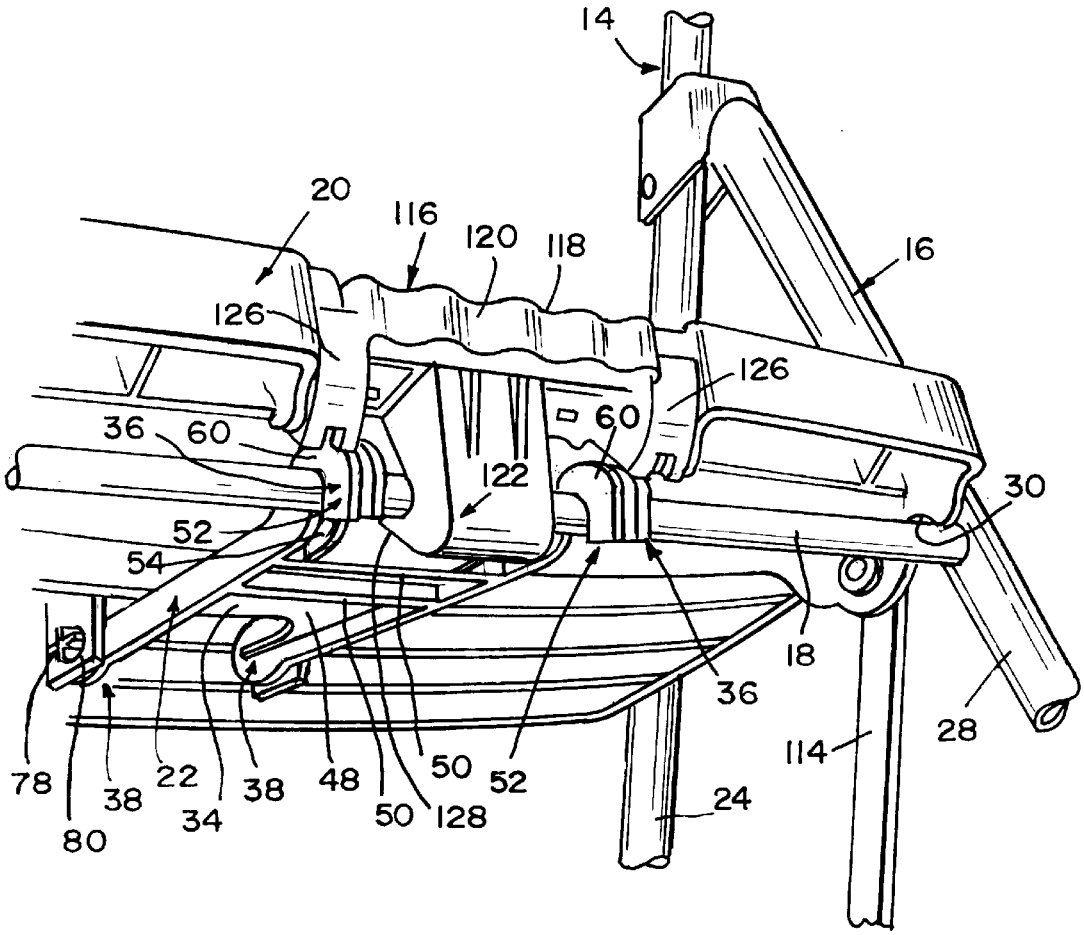
FIG. 7 is a perspective view of the step stool, with portions broken away, showing the front and rear legs positioned in their opened use position, the top step positioned in its horizontal use position, and the link coupled to the strut and the top step.

Frame 12 of step stool 10 is foldable between an opened use position, a shown, for example, in FIGS. 1, 2, and 7, and a closed or collapsed storage position, as shown, for example, in FIGS. 3 and 4. Top ends of rear leg 16 are coupled to front leg 14 for pivotable movement of rear leg 16 relative to front leg 14 between the opened use and closed storage positions. In the opened use position, a bottom end of rear leg 16 is spaced-apart from a bottom end of front leg 14. In the closed storage position, the bottom ends of front and rear legs 14, 16 are positioned adjacent to one another.

Front leg 14 includes a pair of leg members 24, as shown, for example, in FIGS. 1–5 and 7. Each of top step 20 and a bottom step 25 is coupled to leg members 24 for pivotable movement between a horizontal use position and a storage position. Top step 20 is configured to pivot about a pivot axis 26 between its horizontal use position and its storage position.

Rear leg 16 includes a pair of leg member 28, as shown, for example, in FIGS. 1–5 and 7. Strut 18 is coupled to leg members 28.

Figure 5:
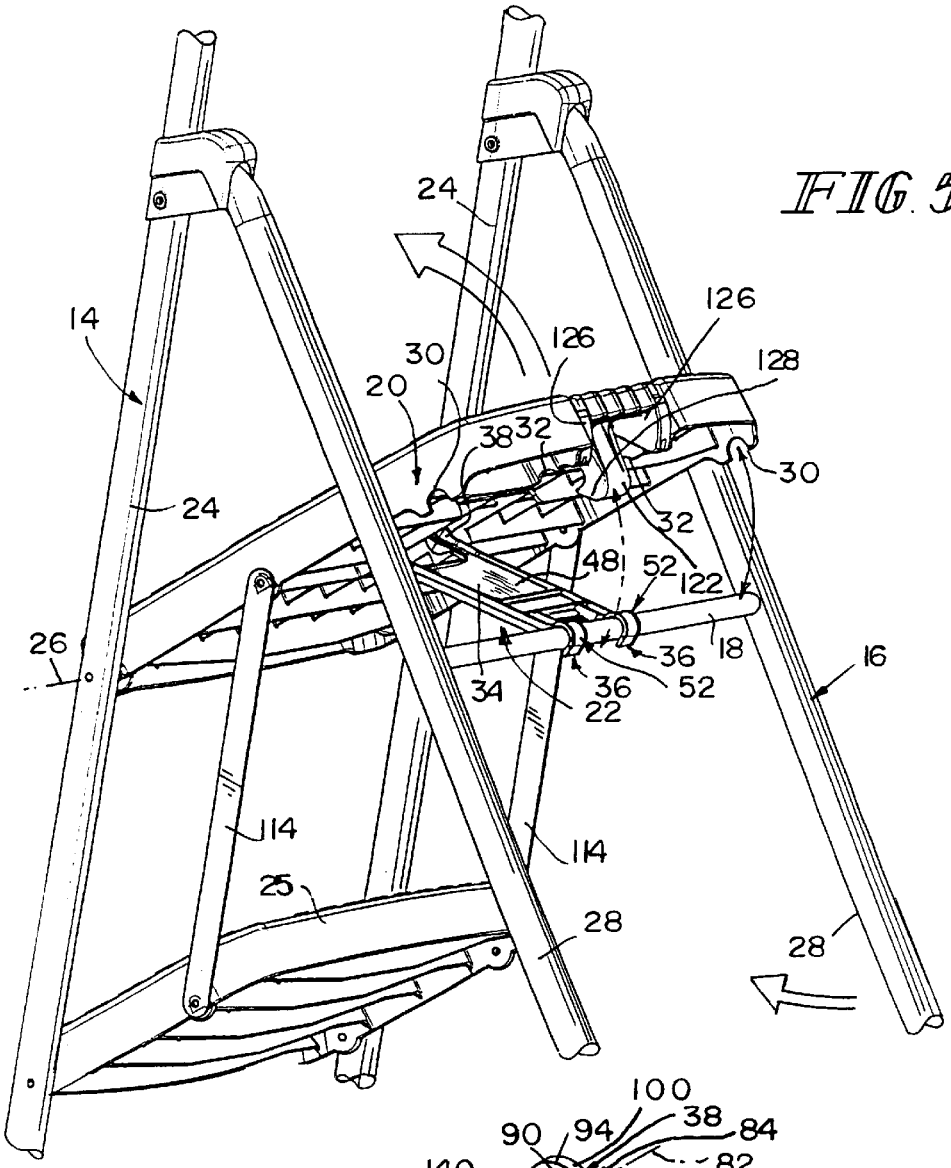
FIG. 5 is a perspective view of the step stool of FIG. 1, with portions broken away, showing the link moving the rear leg toward its closed storage position (as represented by a thick arrow on the step) in response to movement of the step toward its closed position (as represented by a thick arrow on the rear leg)

Top step 20 is formed to include a pair of outer notches 30 and a pair of inner notches 32, as shown, for example, in FIG. 5. Strut 18 is positioned to lie in notches 30, 32 for engagement with step 20 when top step 20 is positioned in its horizontal use position and rear leg 16 is positioned in its opened use position.

Link 22 is coupled to step 20 to move rear leg 16 between the opened use position and the closed storage position in response to movement of step 20 between the horizontal use position and the storage position, as shown, for example, in FIGS. 4, 5 and 7–10. Link 22 could also be used to move step 20 between the horizontal use position and the storage position in response to movement of rear leg 16 between the opened use position and the closed storage position.

Link 22 includes a body 34, a pair of connectors 36 coupled to body 34 and strut 18, and a pair of pivots 38 coupled to body 34 and step 20. Body 34 includes a first side 40, a second side 42 coupled to first side 40, a third side 44 coupled to second side 42, and a fourth side 46 coupled to third side 44 and first side 40. Connectors 36 are coupled to first side 40. Pivots 38 are coupled to third side 44.

Figure 6:
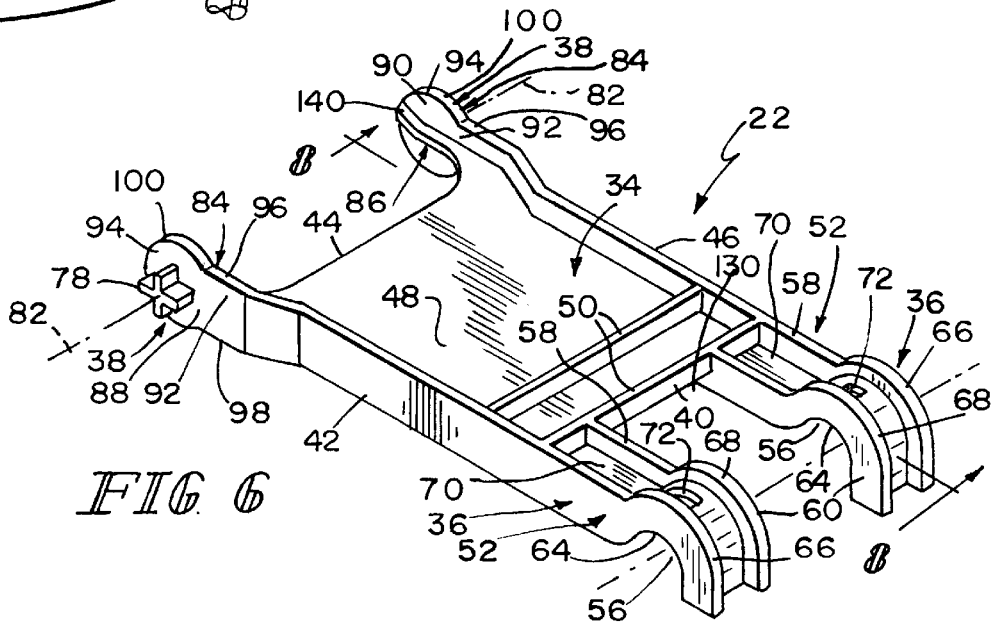
FIG. 6 is a perspective view of the link of FIGS. 2, 4, and 5 showing the link including a body, a pair of connectors coupled to the body, and a pair of pivots coupled to the body.
Figure 10:
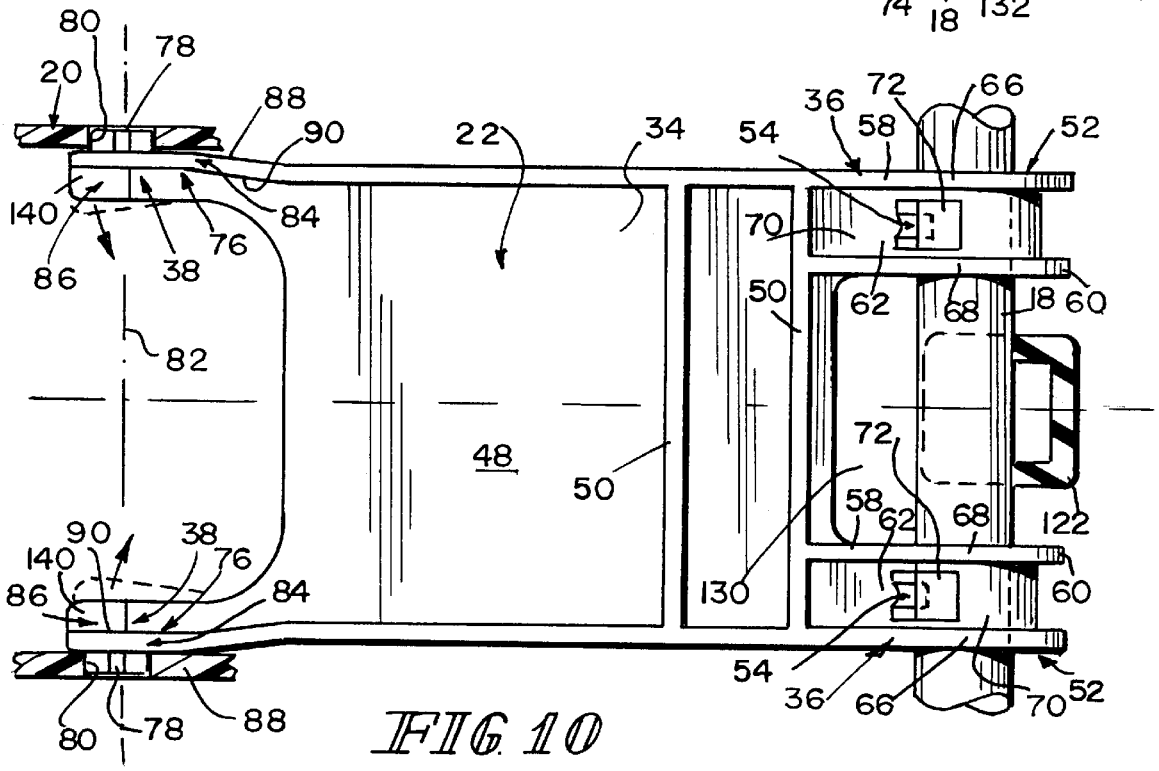
FIG. 10 is a top plan view of the link of FIG. 9 showing the two connectors coupled to the strut and the two pivots coupled to the top step and configured to flex slightly inwardly (as represented by arrows) to allow snap engagement of the pivots with the step.

Body 34 further includes a planar web 48 bounded by the four sides 40, 42, 44, 46, as shown, for example, in FIGS. 6 and 10. Body 34 further includes a pair of stiffening ribs 50 coupled to web 48.

Connectors 36 are similar to one another in structure and function. Thus, the description of one of connectors 36 applies to the other of connectors 36. Connectors 36 provides means for coupling body 34 to strut 18.

Connector 36 includes a hook 52 coupled to first side 40 of body 34 and a detent 54 coupled to hook 52, as shown, for example, in FIGS. 6 and 8–10. Hook 52 is formed to include a channel 56 to receive strut 18 therein. Hook 52 includes an arm 58 coupled to first side 40 of body 34 and an arch 60 coupled to arm 58 at a junction 62 of arm 58 and arch 60. Detent 54 is coupled to junction 62. Arch 60 includes a concave surface 64 that engages strut 18 when strut 18 is positioned in channel 56. Strut 18 slides against concave surface 64 to rotate within channel 56 during movement of rear leg 16 between the opened use and closed storage positions.

Arm 58 and arch 60 cooperate to define a first or outer side wall 66, a second or inner side wall 68, and an intermediate wall 70 coupled to outer and inner side walls 66, 68 to extend therebetween, as shown, for example, in FIGS. 6 and 8–10. Walls 66, 68, 70 are coupled to first side 40 of body 34. Detent 54 is coupled to intermediate wall 70 and is spaced apart from outer and inner side walls 66, 68. Intermediate wall 70 is formed to include an aperture 72.

Figure 8:
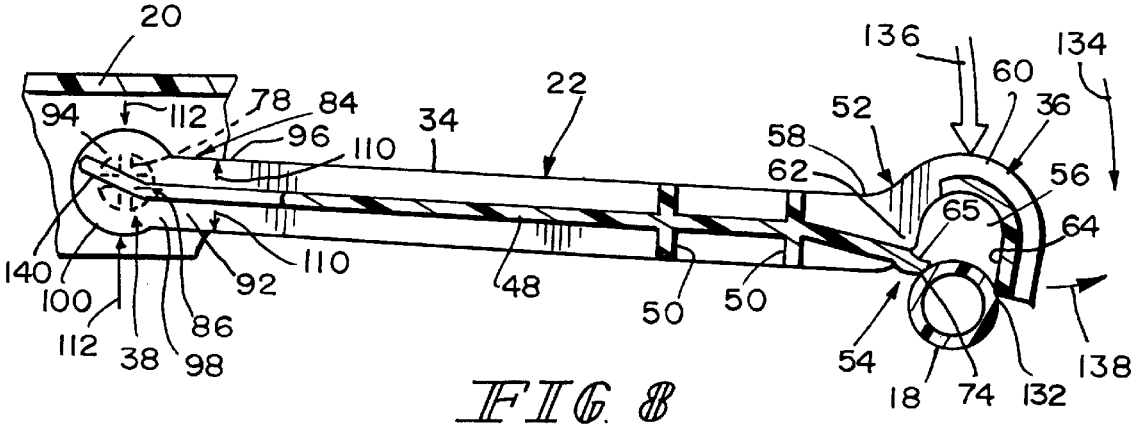
FIG. 8 is a side sectional view taken along line 8—8 of FIG. 6 showing one of the pivots coupled to the step and a force (represented by a thick arrow) pressing one of the connectors onto the strut.
Figure 9:
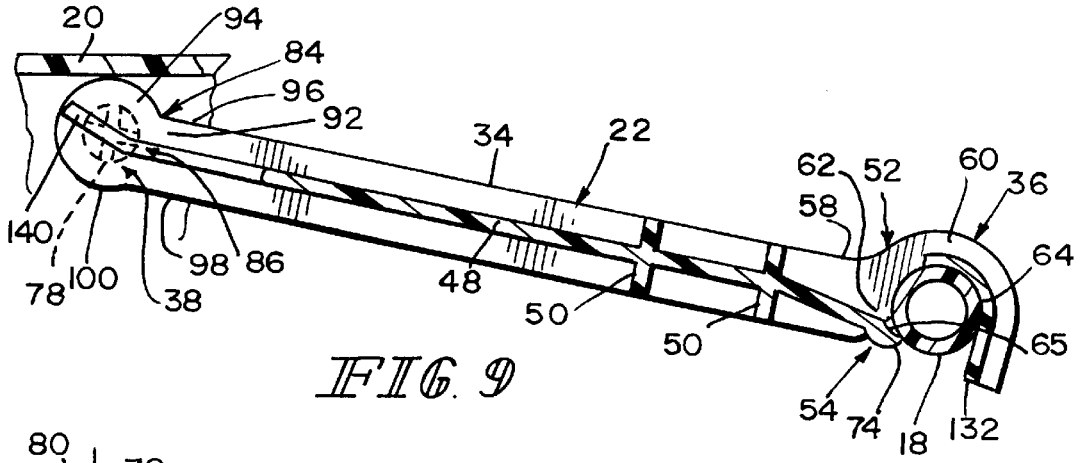
FIG. 9 is a side sectional view similar to FIG. 8 showing the strut positioned to lie in a channel formed by the connector to couple the connector to the strut.

Detent 54 is coupled to hook 52 to retain strut 18 in channel 56, as shown, for example, in FIGS. 8–10. Detent 54 includes a concave surface 65 that faces toward strut 18 when strut 18 is positioned in channel 56.

Detent 54 farther includes a convex cam surface 74 that faces away from concave surface 65. Cam surface 74 engages strut 18 upon snapping strut 18 into channel 56 during assembly of step stool 10, as shown, for example, in FIG. 8 and discussed below.

Pivots 38 are similar to one another in structure and function. Thus, the description of one of pivots 38 applies to the other of pivots 38. Pivots 38 provide means for coupling body 34 to step 20.

Pivot 38 includes an arm 76 that is coupled to third side 44 of body 34 and engages step 20 and an X-shaped boss 78 coupled to arm 76, as shown, for example, in FIGS. 6 and 8–10. Arms 76 curve slightly away from one another as they extend away from third side 44.

Step 20 is formed to include a pair of apertures 80, as shown, for example, in FIGS. 7 and 10. Each boss 78 extends into one of apertures 80 and is configured to engage the edge of step 20 that forms respective aperture 80. Bosses 78 cooperate to define a pivot axis 82 about which link 22 pivots during movement of rear leg 16 between its opened use and closed storage positions and movement of step 20 between its horizontal use and storage positions.

Arm 76 includes a first wall 84 and a second wall 86 coupled to first wall 84 in perpendicular relation thereto, as shown, for example, in FIGS. 6 and 8–10. First wall 84 includes an outer surface 88 and an inner surface 90. Outer surface 88 engages step 20. Boss 78 is coupled to outer surface 88. Inner surface 90 faces away from outer surface 88. Second wall 86 is coupled to inner surface 90 in spaced-apart relation to step 20 and includes an incline 140.

First wall 84 further includes a stem 92 coupled to third side 44 of body 34 and a disk 94 coupled to stem 92 and boss 78, as shown, for example, in FIGS. 6 and 8–10. Stem 92 includes a first edge 96 and a second edge 98 spaced apart from first edge 96. Disk 94 includes a circular edge 100 coupled to first and second edges 96, 98. First and second edges 96, 98 cooperate to define a width 110 therebetween. Circular edge 100 defines a diameter 112 that is greater than width 110. Circular edge 100 is configured to allow pivot 38 to pivot about pivot axis 82 without step 20 interfering with disk 94.

Step stool 10 further includes a pair of step links 114, as shown, for example, in FIGS. 1, 5, and 7. Each step link 114 is coupled to top step 20 and bottom step 25 for pivotable movement relative to each step 20, 25. Step links 114 are configured to pivot bottom step 25 between a horizontal use position and a closed position in response to movement of top step 20 between its horizontal use position and its closed position.

Step stool 10 further includes a latch 116 coupled to top step 20, as shown, for example, in FIGS. 1–5, 7, and 10. A latch similar to latch 116 is disclosed in U.S. patent application Ser. No. 09/762,537, filed Feb. 8, 2001, the disclosure of which is hereby incorporated by reference herein. Latch 116 includes a platform 118 including a finger grip portion 120, and a hook 122 coupled to platform 118. Latch 116 includes a pair of springs (not shown). Each spring engages top step 20 and one of a pair of spring housings 126 of latch 116 to bias latch 116 toward strut 118. Hook 122 includes a cam surface 128 that engages strut 18 upon movement of step 20 from its storage position to its horizontal use position. Latch 116 is configured to pivot about a pivot axis between a latched position and a release position.

Connectors 38 and body 34 cooperate to define a space 130, as shown, for example, in FIGS. 6 and 10. Hook 122 of latch 116 is positioned to lie in space 130 when latch 116 is in its latched position.

During assembly of step stool 10, link 22 is snapped into engagement with strut 18 and top step 20 for movement of rear leg 16 from its opened use position to its closed storage position in response to movement of step 20 from its horizontal use position to its storage position. In particular, connectors 36 are snapped into engagement with strut 18 and pivots 38 are snapped into engagement with step 20 to allow step stool 10 to be readily assembled and to limit expenses associated with manufacturing step stool 10.

Each boss 78 is inserted into one of apertures 80 to snap pivots 38 into engagement with step 20, as shown, for example, in FIG. 10. This causes arms 76 of pivots 78 to engage step 20. Pivots 38 are configured to flex slightly toward one another as pivots 38 are positioned for insertion of bosses 78 into apertures 80.

Link 22 is pivoted about pivot axis 82 in a plane transverse to strut 18 to snap connectors 36 into engagement with strut 18, as shown, for example, in FIG. 8. Link 22 is pivoted in direction 134 so that cam surfaces 74 of detents 54 and edges 132 of arches 60 engage strut 18. Cam surfaces 74 and edges 132 are pressed against strut 18 by a force 136 so that each cam surface 74 slides against strut 18 and each edge 132 moves away from respective detent 54 in direction 138 to allow strut 18 to move past detents 54 into channels 56. Connectors 36 can be snapped onto strut 18 simultaneously or one at a time. Once strut 18 is positioned in channels 56, concave surfaces 64 of arches 60 engage strut 18 and concave surfaces 65 of detents 54 face toward strut 18 to retain strut 18 in channels 56.

Although the invention has been disclosed in detail with reference to certain preferred embodiments, variations and modifications exist within the scope and spirit of the invention as described and defined in the following claims.

What is claimed is:

1. A method of assembling a step stool, the method comprising the steps of providing a frame including a front leg and a rear leg coupled to the front leg for pivotable movement between an opened use position and a collapsed storage position, a step coupled to the front leg for pivotable movement between a horizontal use position and a storage position, and a link including a body, a pivot coupled to the body and the step, and a connector formed to include a channel coupled to the body, and snapping the connector into engagement with the rear leg enabling movement of the rear leg from its opened use position to its closed storage position in response to movement of the step from its horizontal use position to its storage position and retaining the strut in the channel during movement of the rear leg from its opened use position to its closed storage position in response to movement of the step from its horizontal use position to its storage position.

2. The method of claim 1, wherein the providing step includes providing the rear leg with a strut and the connector with a hook coupled to the body and formed to include a channel and the snapping step includes snapping the strut into the channel.

3. The method of claim 2, wherein the providing step includes providing the connector with a detent coupled to the hook and the snapping step includes pressing the detent into engagement with the strut.

4. The method of claim 3, wherein the providing step includes providing the hook with an edge spaced apart from the detent and the snapping step includes pressing the edge into engagement with the strut while pressing the detent into engagement with the strut.

5. The method of claim 4, wherein the snapping step includes moving the edge away from the detent to allow the strut to move past the detent into the channel.

6. The method of claim 3, wherein the providing step includes providing the detent with a cam surface and the snapping step includes sliding the strut against the cam surface into the channel.

7. The method of claim 1, wherein the providing step includes providing another connector coupled to the body and the snapping step includes snapping the other connector into engagement with the rear leg for movement of the rear leg from its opened use position to its closed storage position in response to movement of the step from its horizontal use position to its storage position.

8. The step stool of claim 7, wherein the providing step includes providing each of the connector and the other connector with an arm coupled to the body, an arch coupled to the arm at a junction and formed to include a channel, and a detent coupled to the junction and the snapping step includes sliding the strut against each detent and each arch into each channel.

9. The step stool of claim 7, wherein the providing step includes providing another pivot coupled to the body and further comprising the step of snapping the pivot and the other pivot into engagement with the step.

10. The step stool of claim 1, further comprising the step of snapping the pivot into engagement with the step for movement of the rear leg from its opened use position to its closed storage position in response to movement of the step from its horizontal use position to its storage position.

11. A step stool comprising a frame including a front leg and a rear leg coupled to the front leg for pivotable movement between an opened use position and a collapsed storage position, the rear leg including a strut, a step coupled to the front leg for pivotable movement between a horizontal use position and a storage position, and a link including a body, a pivot that is coupled to the body and the step and defines a pivot axis, and means for coupling the body to the strut in a channel upon pivoting the body about the pivot axis in a plane perpendicular to the strut retaining the strut in the channel during movement of the rear leg from its opened use position to its closed storage position in response to movement of the step from its horizontal use position to its storage position.

12. The step stool of claim 11, wherein the coupling means includes a connector including a hook coupled to the body and formed to include a channel sized to receive the strut therein and a detent coupled to the hook to retain the strut in the channel.

13. The step stool of claim 12, wherein the hook includes an arm coupled to the body and an arch coupled to the arm and formed to include the channel.

14. The step stool of claim 13, wherein the arch includes a concave surface that engages the strut when the strut is positioned in the channel.

15. The step stool of claim 13, wherein the arm is coupled to the arch at a junction and the detent is coupled to the junction.

16. The step stool of claim 12, wherein the hook includes a first side wall, a second side wall spaced apart from the first side wall, and an intermediate wall coupled to the first and second side walls, the first and second side walls and the intermediate wall are coupled to the body, and the detent is coupled to the intermediate wall.

17. The step stool of claim 12, wherein the detent includes a concave surface that faces toward the strut when the strut is positioned in the channel and a convex cam surface that faces away from the concave surface and is configured to engage the strut when the strut is positioned in the channel.

18. The step stool of claim 12, wherein the coupling means further includes another connector including a hook coupled to the body and formed to include a channel sized to receive the strut therein and a detent coupled to the hook of the other connector to retain the strut in the channel.

19. The step stool of claim 18, further comprising a latch that is coupled to the step and engages the strut when the rear leg is positioned in its opened use position to lock the rear leg in its opened use position, and wherein the hook of the connector, the hook of the other connector, and the body cooperate to define a space in which the latch is positioned when the latch engages the strut.

20. A step stool comprising a frame including a front leg and a rear leg coupled to the front leg for pivotable movement between an opened use position and a collapsed storage position, the rear leg including a strut, a step coupled to the front leg for pivotable movement between a horizontal use position and a storage position, and a link including a body, a pivot coupled to the body, and a connector coupled to the body, the connector including a hook coupled to the body and formed to include a channel sized to receive the strut and a detent coupled to the hook retaining the strut in the channel upon snapping the connector into engagement with the strut retaining the strut in the channel during movement of the rear leg from its opened use position to its closed storage position in response to movement of the step from its horizontal use position to its storage position.

21. The step stool of claim 20, wherein the hook includes an arm coupled to the body and an arch coupled to the arm and formed to include the channel.

22. The step stool of claim 21, wherein the arch includes a concave surface that engages the strut.

23. The step stool of claim 21, wherein the arm is coupled to the arch at a junction and the detent is coupled to the junction.

24. The step stool of claim 21, wherein the hook includes a first side wall, a second side wall spaced apart from the first side wall, and an intermediate wall coupled to the first and second side walls and the first and second side walls and the intermediate wall are coupled to the body.

25. The step stool of claim 24, wherein the detent is coupled to the intermediate wall and spaced apart from the first and second side walls.

26. The step stool of claim 21, wherein the detent includes a concave surface that faces toward the strut when the strut is positioned in the channel.

27. The step stool of claim 26, wherein the detent includes a convex cam surface that faces away from the concave surface and is configured to engage the strut upon snapping the strut into the channel.

28. The step stool of claim 21, further comprising another pivot coupled to the body and the step and another connector including another hook coupled to the body and formed to include another channel sized to receive the strut and the other detent coupled to the other hook to retain the strut in the other channel upon snapping the other connector into engagement with the strut.

29. The step stool of claim 28, wherein the body includes a first side, a second side coupled to the first side, a third side coupled to the second side, and a fourth side coupled to the third side and the first side, the hook and the other hook are coupled to the first side, and the pivot and the other pivot are coupled to the third side.

30. The step stool of claim 28, further comprising a latch that is coupled to the step and engages the strut when the rear leg is positioned in its opened use position to lock the rear leg in its opened use position, and wherein the hook, the other hook, and the body cooperate to define a space in which the latch is positioned when the rear leg is positioned in its opened use position.

31. The step stool of claim 21, wherein the pivot is formed to include means for snapping the pivot into engagement with the step to move the rear leg from its opened use position to its closed storage position in response to movement of the step from its horizontal use position to its storage position.

* * * * *